US005080383A

United States Patent [19]

Hsieh

[11] Patent Number: 5,080,383

[45] Date of Patent: Jan. 14, 1992

[54] BABY-WALKER WITH A TEMPORARILY STOPPING DEVICE AND A SAFETY BELT

[76] Inventor: Chen C. Hsieh, No. 1, Alley 2, Lane 474, Chung-Ho St., Pei-Tou District, Taipei, Taiwan

[21] Appl. No.: 674,533

[22] Filed: Mar. 22, 1991

[51] Int. Cl.[5] ..... B62B 7/00

[52] U.S. Cl. ..... 280/87.051; 188/5; 272/70.3

[58] Field of Search ..... 280/87.01, 87.021, 87.03, 280/87.041, 87.05, 87.051, 641, 288.4, 642, 298, 644, 299, 649, 301, 650, 302, 658, 47.34, 47.38, 79.2; 272/70.3; 188/5, 6, 7

[56] References Cited

U.S. PATENT DOCUMENTS 4,699,392 10/1987 Ku ..... 280/87.051

4,822,030 4/1989 Cone ..... 280/87.051

4,844,209 7/1989 Sedlack ..... 188/5

*Primary Examiner*—Andres Kashnikow

*Assistant Examiner*—Richard Camby

*Attorney, Agent, or Firm*—Helfgott & Karas

[57] ABSTRACT

A baby-walker with a temporarily stopping device and a safety belt which includes a drum pivotally secured on the frames of the baby-walker and having therein a torsion spring wound around a central shaft, a sheet of cloth of which one end is received in the drum and the other portion of the cloth is wound around the drum, and several fastening elements, opposite to the drum, fixed on the base of the baby-walker. By unwinding the cloth and securing the free end of the cloth on the base of the baby-walker with the fastening elements hooking the cloth, the baby-walker will not move when baby steps on the cloth.

3 Claims, 7 Drawing Sheets

BABY-WALKER WITH A TEMPORARILY STOPPING DEVICE AND A SAFETY BELT

FIELD OF THE INVENTION

The present invention relates, in general, to a baby-walker with a temporarily stopping device used for preventing the baby-walker which carries the baby from moving when parents leave for other place for a while and temporarily can not look after the baby or when parents want to feed the baby or to take a picture of the baby, and with a safety belt.

BACKGROUND OF THE INVENTION

It is known that the baby-walker can provide the effects of learning walking and playing for baby. But, in the conventional baby-walker, when the baby carried by the baby-walker is not attended by parents, it will always put the baby to danger, such as falling down from the stairs, or sliding to some dangerous region like kitchen . . . etc. to touch the dangerous items, and cause the wound or even death of the baby. In U.S.A., in the year of 1988, as per statistics by the American Consumer Goods Safety Commission, there are 19,150 wounded babies brought to the hospital for first-aid due to the falling of the baby-walker down from the stairs and at least three babies died.

However, up to date, there is still no improved baby-walker sold in the market. When Parents temporarily can not attend the baby, they try to tie and secure the baby-walker on the leg of the desk or other stationary objects to avoid the above-described danger. By this way, there are still some problems or disadvantages, such as, it is not easy to find a suitable leg of desk or other stationary objects which are strong enough to be used for tying and securing the baby-walker, and the leg of desk or other stationary objects may cause another kind of danger and wound the baby.

SUMMARY OF THE INVENTION

The object of the present invention is thus to provide a baby-walker with a temporarily stopping device which can eliminate the above-described disadvantages and danger.

The temporarily stopping device of the baby-walker according to the present invention mainly includes a drum, a sheet of cloth, several fastening elements and an elongate bar. A torsion spring and a central shaft are mounted within the drum. The torsion spring winds around the central shaft and one bending end thereof fits into a hole provided in the central shaft and the other bending end thereof fits into a hole provided in the outer surface of the roller. The drum is pivotally secured on the support of the baby-walker by using the central shaft extending through two central holes provided respectively in two covers mounted respectively at two ends of the drum and fixed onto the support of the baby-walker. A groove is provided on the upper surface of the drum and extends longitudinally from one end to the drum to the point adjacent to the other end of the drum. One end of the cloth is folded and sewed into a receiving portion for receiving a metal rod. The receiving portion with the metal rod therein formed a stop portion is received within the drum and above the central shaft while the other portion of the cloth, excluding the receiving portion, extends outwardly from the groove. The other end of the cloth is provided with several eyelets and a stop element, such as a piece of canvas, provided at the rear side of the cloth and adjacent to the center of the end of cloth having the eyelets. The elongate bar is provided above the drum at an appropriate distance from the drum and is also fixed onto the support of the baby-walker. When the cloth is not in use, the cloth is wound around the drum and the free end of the cloth (i.e., the end having the eyelets) is retained against the elongate bar. The fastening elements opposite to the drum are fixed on the base of the baby-walker. When parents leave for other place for a while and temporarily can not look after the baby on the baby-walker, or hope the baby-walker will not move while feeding the baby, they may then unwind the cloth of the temporarily stopping device of the present invention on the base of the baby-walker; because the length of the cloth is such appropriately designed that the unwound cloth will touch the ground when baby steps on and exerts a force on the unwound cloth, and then the baby-walker will not move.

BRIEF DESCRIPTION OF THE DRAWINGS

The objects, features and advantages of the present invention will become apparent to those skilled in the art upon reviewing the following description of the preferred embodiment and the accompanying figures, in which.

BRIEF DESCRIPTION OF THE DRAWINGS

Figure 1:
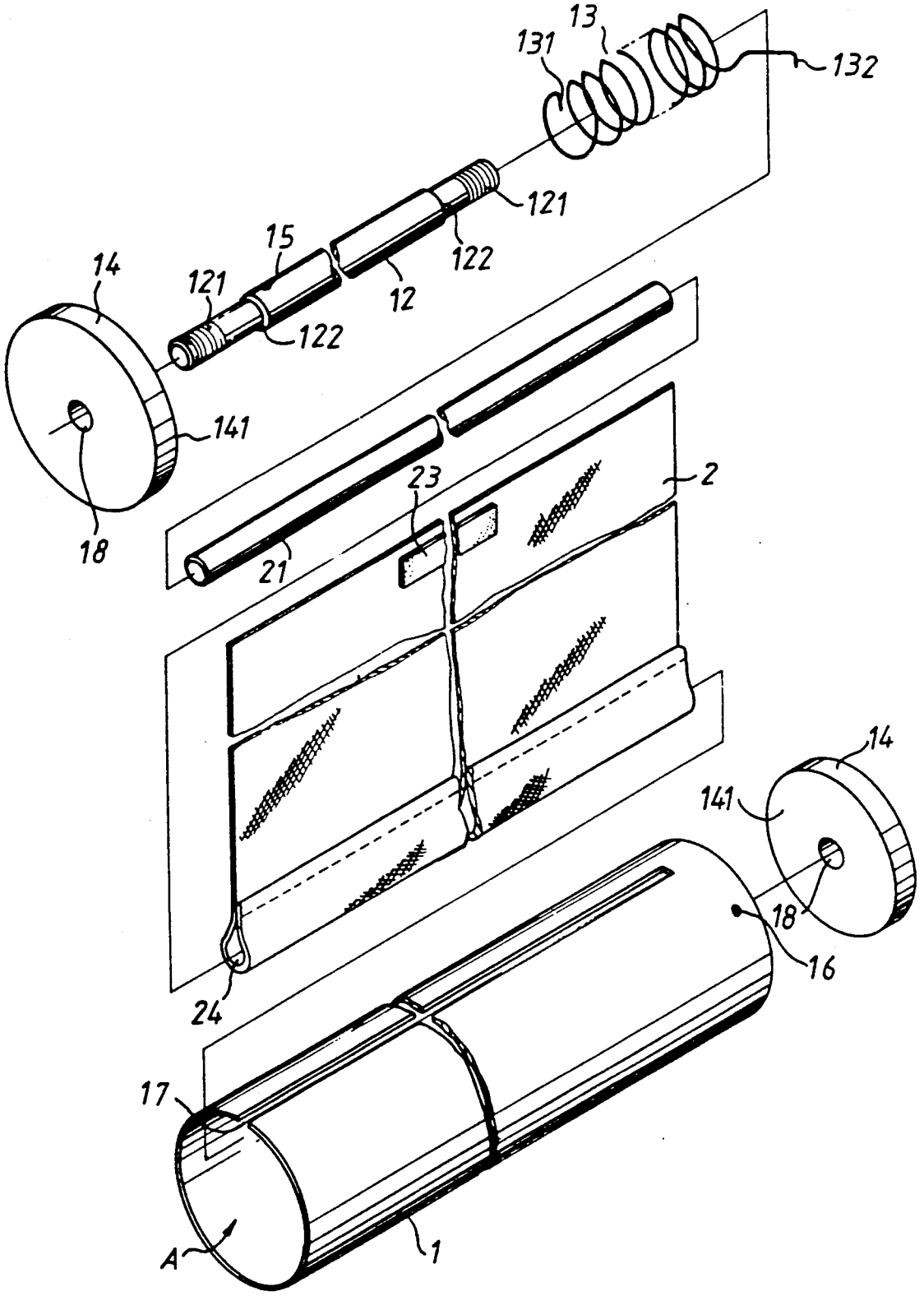
FIG. 1 is an exploded view of the drum of an embodiment of the present invention.
Figure 2:
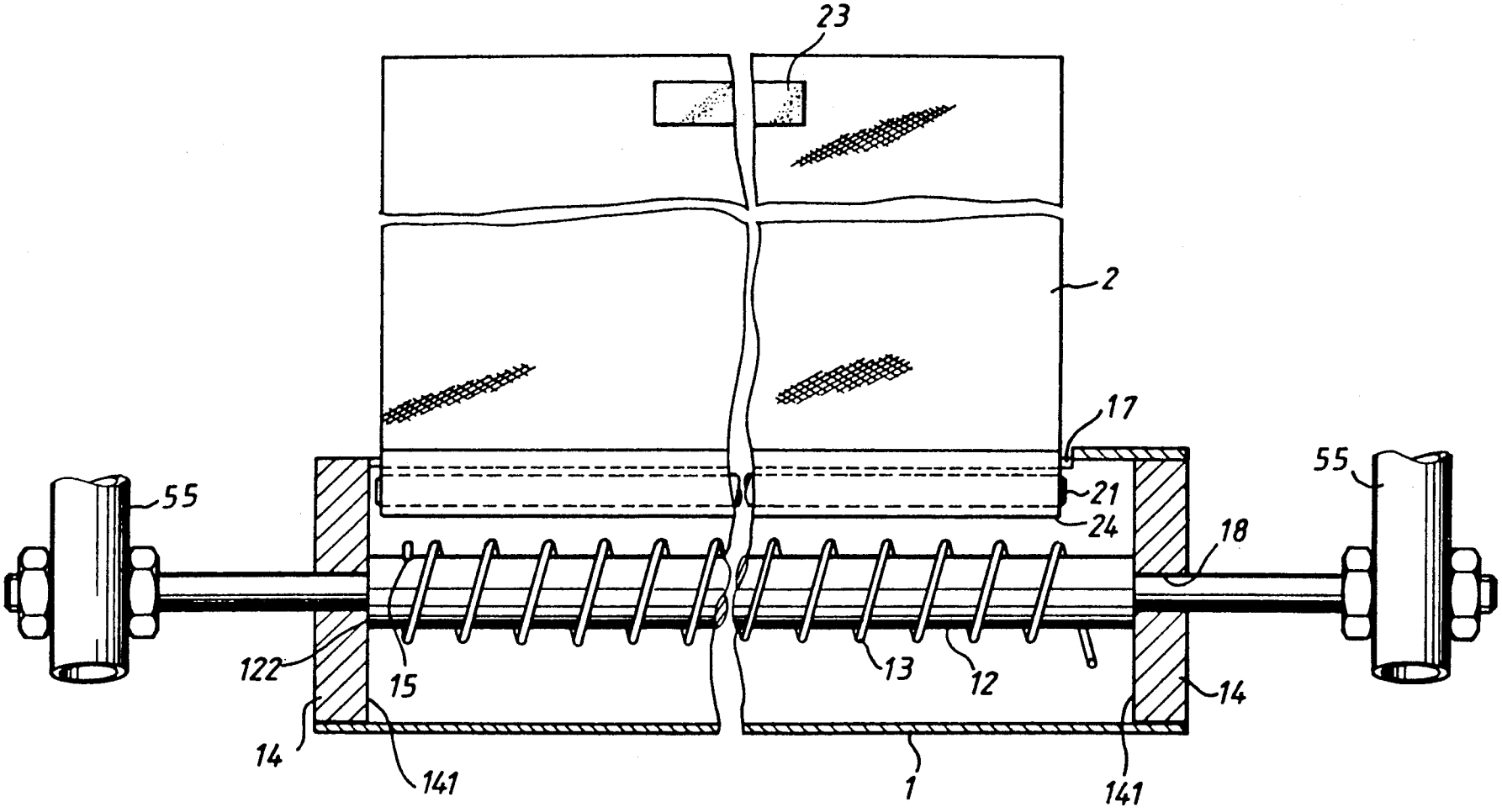
FIG. 2 is a sectional view illustrating of the drum of the present invention fixed on the support of the baby-walker.
Figure 5:
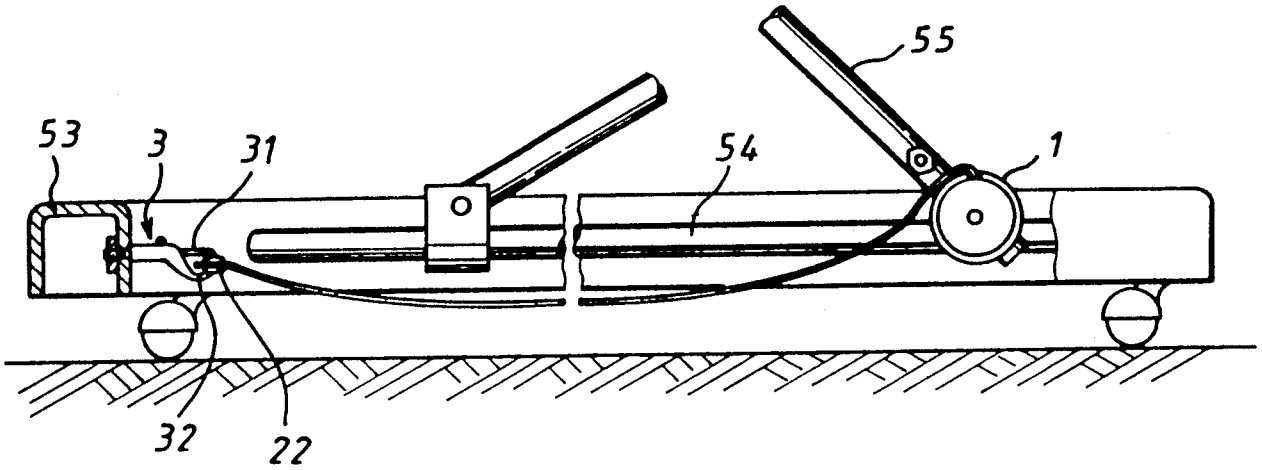
FIG. 5 is schematic view of an embodiment of the present invention illustrating the cloth which is unwound and placed on the base of the baby-walker.
Figure 6:
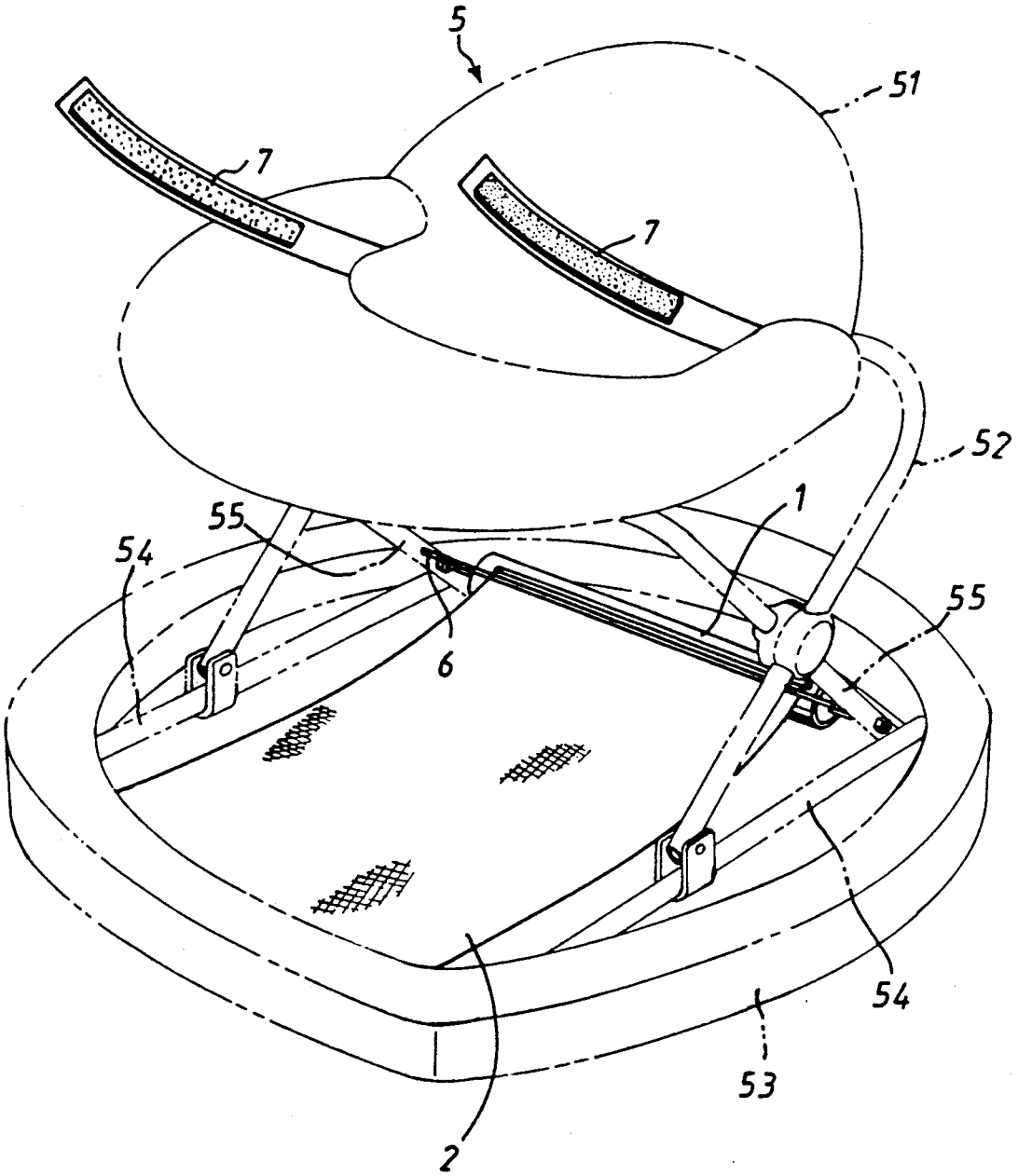
FIG. 6 is a three-dimensional view illustrating the baby-walker having the temporarily stopping device of the present invention with the unwound cloth on the base of the baby-walker.

Please refer to FIGS. 1, 2, 5 and 6. The temporarily stopping device of the present invention can be secured onto a conventional baby-walker. Referring to FIG. 6, a conventional baby-walker (5) includes a seat (51) in the upper portion of the baby-walker, two pivotally connected inverted U-shaped tubular supports (52) in the middle portion of the baby-walker each connected between the seat (51) and a connecting bar (54) longitudinally fixed on a substantial rectangular base (53) in the lower portion of the baby-walker. Referring to FIG. 1, the temporarily stopping device of the present invention includes a drum (1) having 30 mm in inner diameter, a sheet of cloth (2), an elongate bar (6) and several fastening elements (3); a torsion spring (13) having 8 mm in inner diameter and 10 mm in outer diameter and a central shaft (12) having 5 mm in diameter are mounted within the drum (1). The torsion spring (13) winds around the central shaft (12) and has one bending end (131) fitted into a hole (15) provided in the central shaft (12) and the other bending end (132) fitted into a hole (16) provided in the outer surface of the drum (1). The central shaft (12) has two end portions (121) of a reduced diameter and the two end portions (121) each has a threaded portion at the end thereof. Referring to FIGS. 2 and 6, the drum (1) can be pivotally secured onto two lower end portions (55) of one inverted U-shaped tubular support (52) of the baby-walker (5) and be adjacent to the rear side of the base (53), which is implemented by means of the central shaft (12) which extends through two central holes (18) provided respectively in two covers (14) mounted respectively at two ends of the drum (1) and of which each end is screwed on the two lower end portions (55) of the inverted U-shaped tubular support (52) of the baby-walker by nuts, wherein the inner surface (141) of each cover (14) rests against the shoulder (122) of the central shaft (12) separating the portions of small and large diameters. The central shaft (12) must be fixed to avoid rotation. A groove (17) having 2 mm in width is provided on the upper surface of the drum (1), which groove (17) longitudinally extends from one end of the drum (1) to the point adjacent to the other end of the drum (1).

Figure 3:
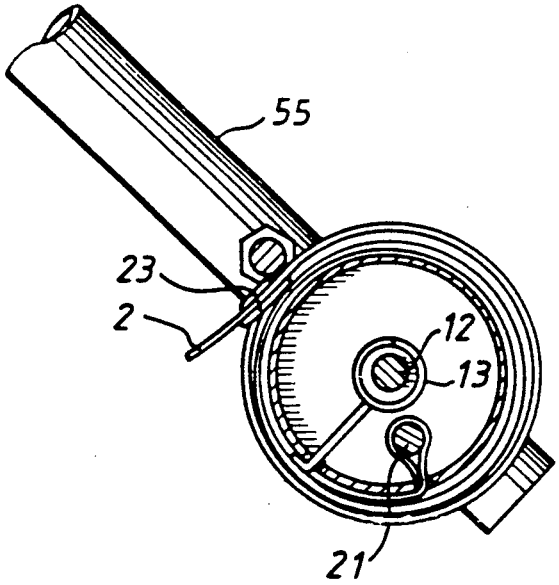
FIG. 3 is schematic view of an embodiment of the present invention illustrating the cloth which is wound around the drum.
Figure 4:
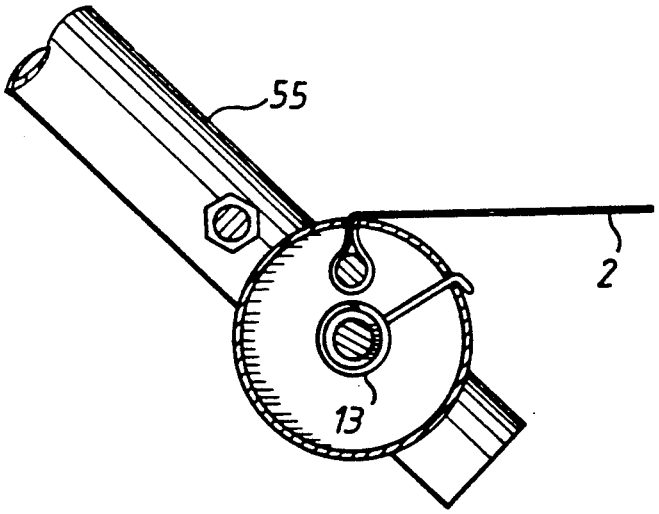
FIG. 4 is schematic view of an embodiment of the present invention illustrating the cloth which is unwound.

The cloth (2) can be a canvas having 1 mm in thickness. One end of the cloth is folded and sewed into a receiving portion (24) for receiving a metal rod (21) having 4 mm in diameter; the receiving portion (24) with the metal rod (21) therein forms into a stop portion which is inserted from one side (such as side A shown in FIG. 1) of the drum (1) when the cover 14 has not yet covered the drum (1) while the other portion of the cloth, excluding the receiving portion (24), passes through the groove (17) such that the stop portion is received within the drum (1) and above the central shaft (12). The stop portion can prevent the receiving portion (24) of the cloth (2) from escaping from the drum (1). The other end (namely the free end) of the cloth (2) is provided with several eyelets (22) (FIG. 5) and a stop element (23) (FIG. 3), such as a piece of canvas, is provided at the rear side of the cloth and adjacent to the center of the end of cloth having the eyelets. The elongate bar (6) (FIG. 6) is provided above the drum (1) at an appropriate distance from the drum (1) and is also screwed onto the two lower end portions (55) of the support (52) of the baby-walker. When the cloth (2) is not in use, the cloth (2) can be wound around the drum (1) and the free end of the cloth (2) (i.e., the end having eyelets) is retained against the elongate bar (6).

The fastening elements (3) opposite to the drum (1) are screwed on another side of the base (53) of the baby-walker (5). The number of the fastening elements (3) is equal to the eyelets (22) in the cloth (2), and each fastening element (3) includes a slider (31) and a hook portion (32) (FIG. 5). When the temporarily stopping device is in use, the cloth (2) can be drawn towards the fastening elements (3) and secured on the base of the baby-walker by moving the slider (31) and using the hook portions (32) of the fastening elements (3) to hook the cloth (2) via the eyelets (22) of the cloth (2) (FIG. 5) and when the cloth (2) is released from the fastening elements (3), it can be rewound around the drum (2) by means of the torsion of the torsion spring (13).

Figure 7:
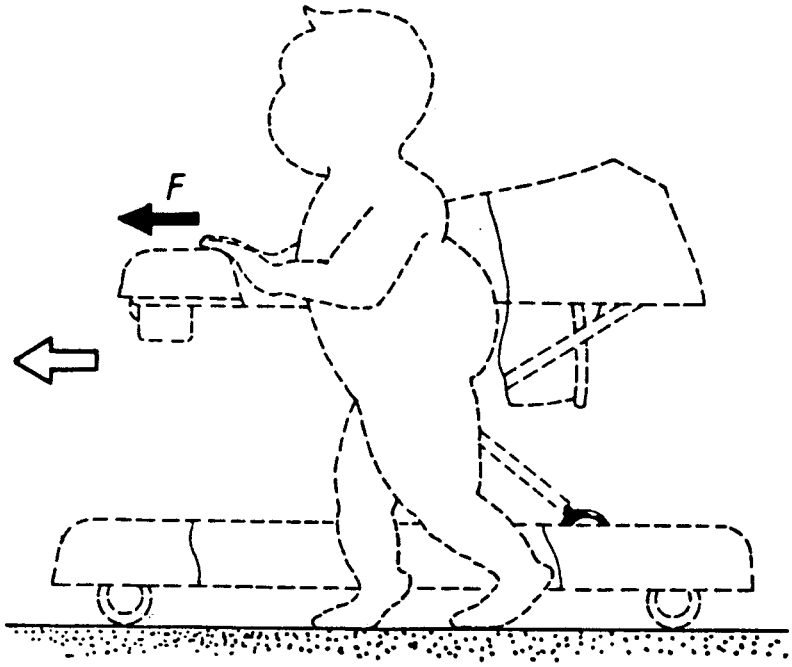
FIG. 7 and FIG. 8 illustrating a baby exerting a force to move the baby-walker when the cloth of the temporarily stopping device of the present invention is not in use.
Figure 9:
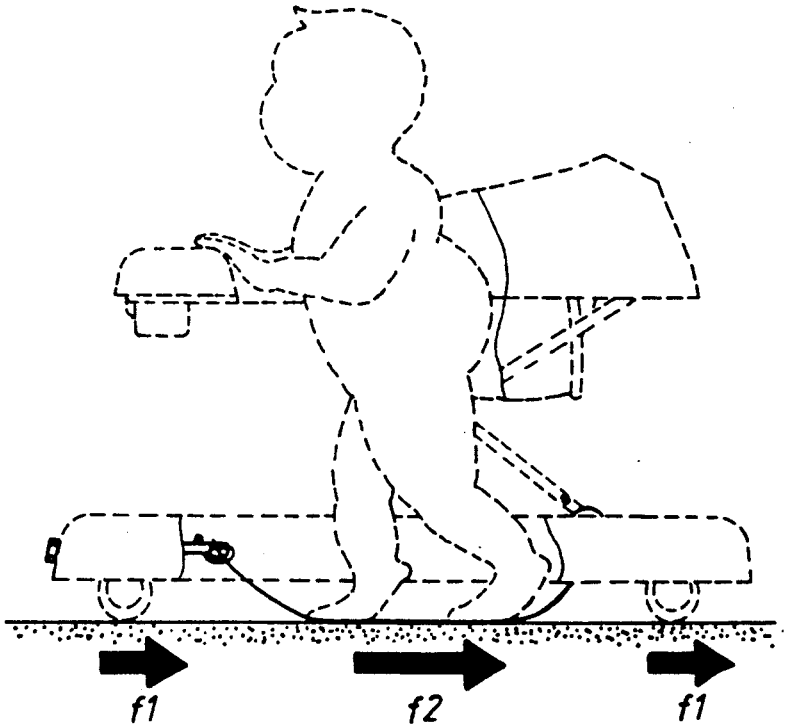
FIG. 9 illustrating a baby exerting a force on the baby-walker with the unwound cloth of the temporarily stopping device on the base of the baby-walker.
Figure 8:
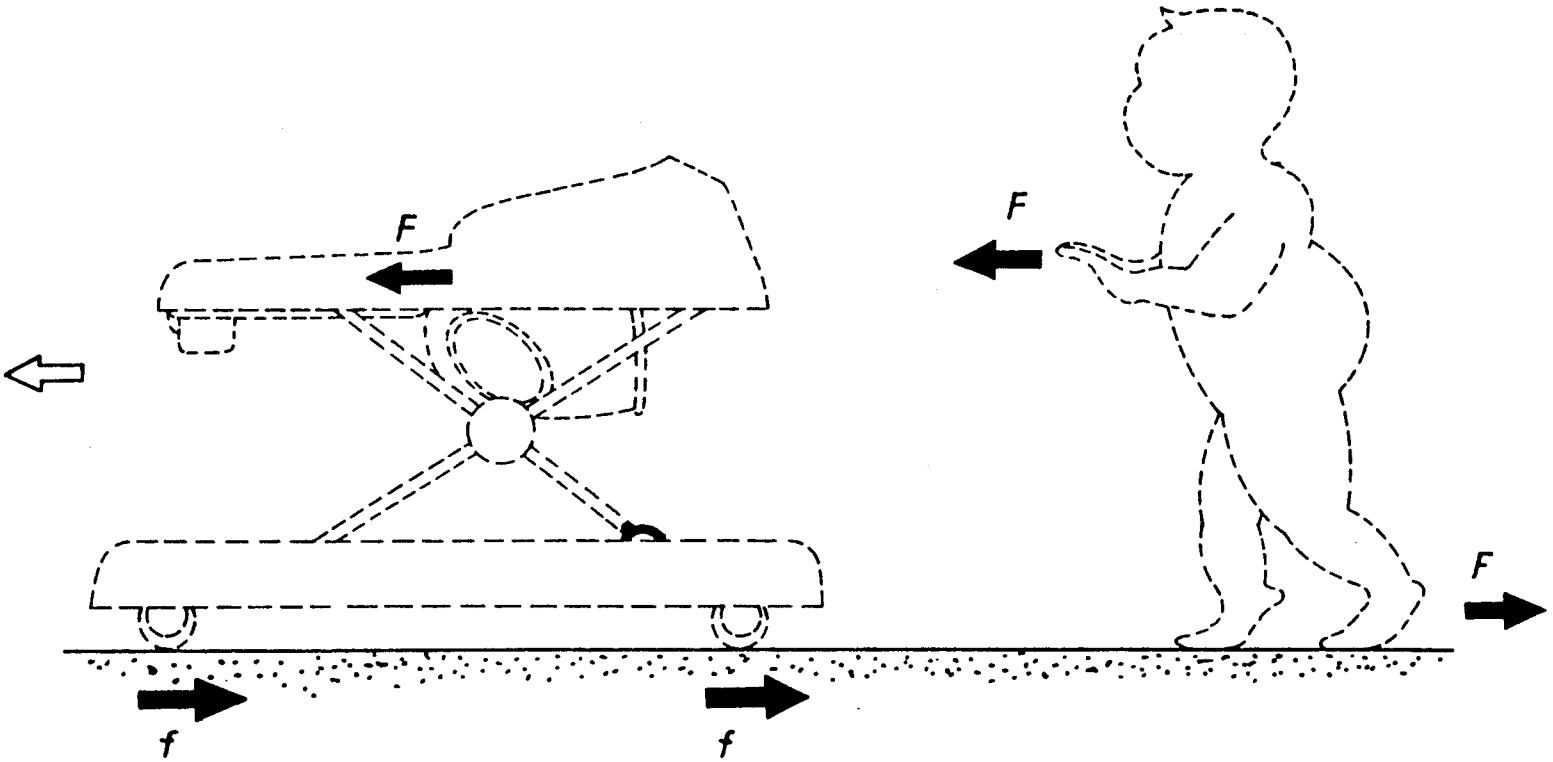

When parents unwind the cloth and secure the cloth on the base of the baby-walker, because the length of the cloth is such appropriately designed that the unwoud cloth will touch the ground when baby steps on and exerts a force on the unwound cloth, thus the baby-walker will not move. The force that moves the baby-walker must be lager enough to overcome the friction force between the ground and the baby-walker. When the cloth of temporarily stopping device is rewound around the drum, the force exerted on the baby-walker by the baby is an external force which can overcome the friction force between the ground and the wheels of the baby-walker and move the baby-walker. But, when the cloth of the temporarily stopping device is unwound and is stepped on by the baby, the force exerted on the baby-walker by the baby has become an internal force because the baby together with the baby-walker can be deemed to be a whole body at this time and thus the friction force between the ground and the baby-walker can not be overcomed; so, if no other external force exerted on the baby-walker, the baby-walker will not move. These explanations can be more easily understood from FIGS. 7-9. FIG. 7 illustrates a baby exerting an external force on the baby-walker without stepping on the cloth of the temporarily stopping device. FIG. 8 is used to explain FIG. 7 in which the baby exerts an exteranl force (F) which over-comes the friction force (f) between the ground and the wheels of the baby-walker and moves the baby-walker. FIG. 9 illustrates that when the cloth of the temporarily stopping device is unwound and the baby steps on the cloth which reaches the ground, the force exerted on the baby-walker by the baby has become internal force. Hence, if no other external force exerted on the baby-walker to overcome the friction force (f1) and (f2) produced between the ground and the wheels and cloth of the baby-walker, the baby-walker will not move. When the cloth of the temporarily stopping device of the baby-walker is not in use and is rewound around the drum, the baby-walker still can provide the effect of learning walking and playing for baby.

Referring to FIG. 6, the baby-walker (5) is further provided with a safety belt including two connecting parts (7) which are respectively at one end fixed on two opposite sides of the seat (51). One connecting part (7) can be a loop-tape portion of a Velcro tape and the other connecting part (7) can be a hook-tape portion of a Velcro tape such that these two connecting parts can be connected together to form a safety belt. When baby is stepping on the unwound cloth secured and placed on the base of the baby-walker, the safety belt can prevent the baby from exerting excess force on the baby-walker and thus can prevent the baby-walker from swaying. The safety belt also can be other conventional fastener.

The present invention is constructed by the above-described elements. If parents hope the baby-walker will not move when they leave for other place for a while and temporarily can not look after the baby carried by the baby-walker or when they feed the baby or take a picture of the baby, the present invention can provide a temporarily stopping device to meet the above requirements, and the most important effect of the present invention is to avoid the danger or accidents caused by the conventional baby-walker, such as falling down from the stairs or sliding to some dangerous place etc.

The present invention has been described as above. However, it should be noted that the above description is for illustration rather than restriction and in light of this illustration one skilled in this art can make various modifications without departing from the true spirit and domain of the present invention. Therefore, the scope of the present invention should be defined by the following claims.

I claim:

1. A baby-walker with a temporarily stopping device and a safety belt including a seat in the upper portion of said baby-walker and a safety belt fixed on said seat, two pivotally connected inverted U-shaped tubular supports in the middle portion of said baby-walker each connected between said seat and a connecting bar longitudinally fixed on a substantial rectangular base in the lower portion of said baby-walker, and a temporarily stopping device secured onto two lower end portions of one of said two inverted U-shaped tubular supports and including a drum having therein a torsion spring which winds around a central shaft extending through the ends of said drum and is connected to said central shaft and said drum at ends, said drum pivotally secured onto said two lower end portions of said support, and adjacent to one side of said base by securing the two ends of said central shaft onto said two lower end portions of said support, a sheet of cloth having one end portion formed a stop portion received within said drum while the other portion of the cloth is wound around said drum and can be unwound if necessary and having several eyelets in the other end portion thereof which is a free end, and several fastening elements, opposite to said drum, fixed on said base, characterized in that:

said cloth can be unwound and said free end of said cloth can be releasablly secured on said base of said baby-walker by means of said fastening elements such that when baby is carried by said baby-walker, baby can step on said cloth which length is appropriately designed and will touch the ground as the baby steps on so that said baby-walker will not move, and when said cloth is released, said cloth will be rewound around said drum by means of the torsion of said torsion spring.

2. The baby-walker with a temporarily stopping device and a safety belt of claim 1 further including a stop element provided at the rear side of said cloth and adjacent to the center of said free end portion of said cloth and an elongate bar provided parallely above said drum at an appropriate distance from said drum and also fixed onto said two lower end portions of said support whereby when said cloth can be wound around said drum, said free end of said cloth can rest against said elongate bar.

3. The baby-walker with a temporarily stopping device and a safety belt of claim 1 wherein said safety belt includes two connecting parts which are respectively at one end fixed on two opposite sides of said seat, one connecting part being a loop-tape portion of a Velcro tape and the other connecting part being a hook-tape portion of a Velcro tape such that these two connecting parts can be connected together to form a safety belt.

* * * * *